US008567478B2

(12) United States Patent
Hirata et al.

(10) Patent No.: US 8,567,478 B2
(45) **Date of Patent: *Oct. 29, 2013**

(54) METHOD FOR MAKING UPPER AND LOWER MOLDS AND AN APPARATUS THEREFOR

(71) Applicants: Minoru Hirata, Toyokawa (JP); Yutaka Hadano, Toyokawa (JP); Tsutomu Seki, Toyokawa (JP)

(72) Inventors: Minoru Hirata, Toyokawa (JP); Yutaka Hadano, Toyokawa (JP); Tsutomu Seki, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/647,947

(22) Filed: Oct. 9, 2012

(65) Prior Publication Data

US 2013/0118703 A1 May 16, 2013

Related U.S. Application Data

(62) Division of application No. 11/997,415, filed as application No. PCT/JP2006/315654 on Aug. 8, 2006, now abandoned.

(30) Foreign Application Priority Data

Aug. 10, 2005 (JP) ..... 2005-231783

(51) Int. Cl.
*B22C 15/00* (2006.01)

(52) U.S. Cl.
USPC ..... 164/37; 164/151; 164/456

(58) Field of Classification Search
USPC ..... 164/37, 151, 456
See application file for complete search history.

(56) References Cited

U.S. PATENT DOCUMENTS

| | | | | |
|---|---|---|---|---|
| 7,594,532 | B2 * | 9/2009 | Hirata et al. | 164/456 |
| 2002/0129917 | A1 | 9/2002 | Kaneto et al. | |

FOREIGN PATENT DOCUMENTS

| | | | |
|---|---|---|---|
| DE | 33 12 539 | A1 | 3/1984 |
| JP | 59-73184 | | 4/1984 |
| JP | 04-274838 | | 9/1992 |
| JP | 2004-66280 | | 3/2004 |
| WO | WO 2005/0058528 | A1 | 6/2005 |

* cited by examiner

*Primary Examiner* — Nicholas P D'Aniello
(74) *Attorney, Agent, or Firm* — Finnegan, Henderson, Farabow, Garrett & Dunner, L.L.P.

(57) ABSTRACT

The purpose of this invention is to provide a method for making upper and lower molds and an apparatus therefor that can prevent the resulting molds from being warped and match-plates from being broken.

The method of this invention comprises the step of holding a match-plate 1 between cope and drag flasks 2 and 3, inserting upper and lower squeezing means 4 and 5 into the respective openings of the cope and drag flasks 2 and 3, which openings are opposite to the match-plate 1, so as to define upper and lower molding spaces, supplying molding sand to the upper and lower molding spaces, and then causing the upper and lower squeezing means 4 and 5 to move forward to the match-plate 1 so as to squeeze the molding sand and make upper and lower molds, wherein during the step of causing the upper and lower squeezing means to move forward to the match-plate the difference between the squeezing pressures of the upper and lower molding spaces is kept within a predetermined tolerance.

2 Claims, 1 Drawing Sheet

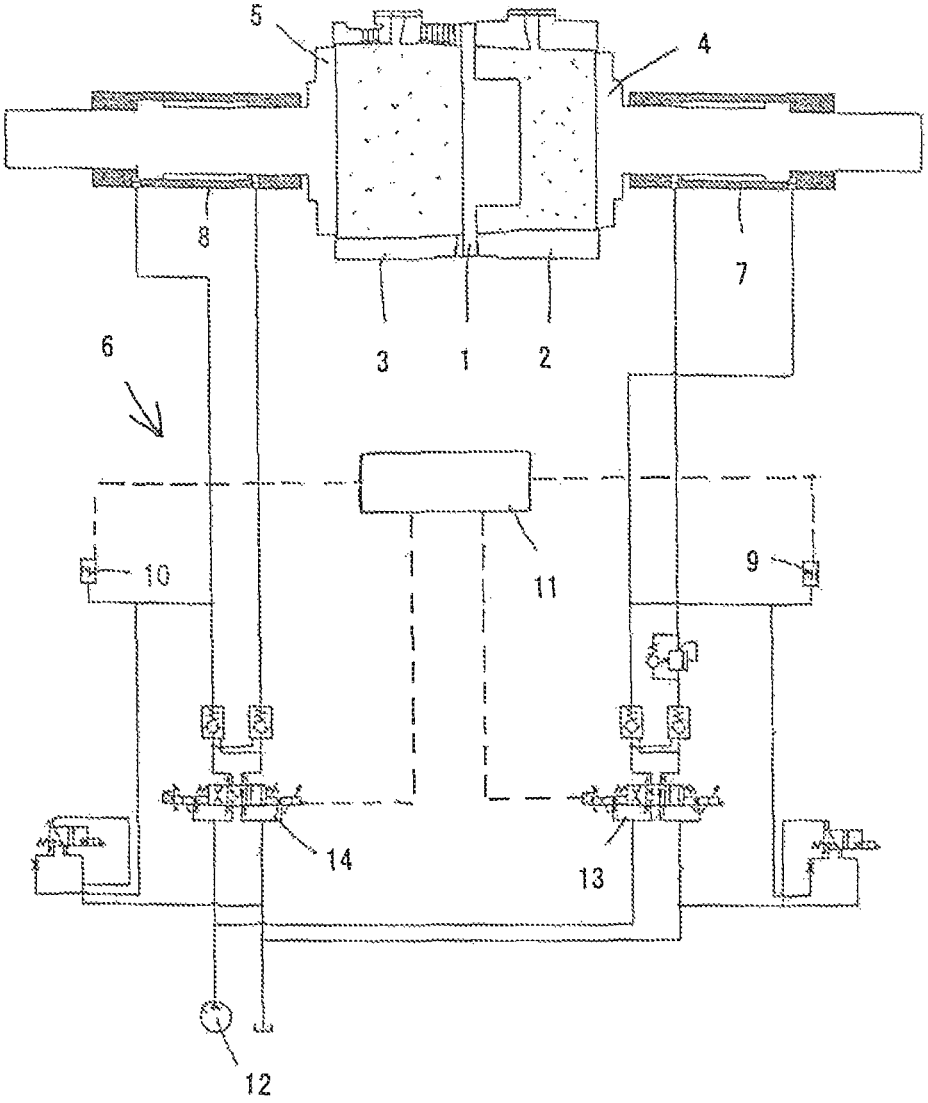
5
4
8
7
3
1
2
6
10
11
9
14
13
12

METHOD FOR MAKING UPPER AND LOWER MOLDS AND AN APPARATUS THEREFOR

RELATED APPLICATIONS

This application is a divisional of U.S. application Ser. No. 11/997,415, filed Mar. 9, 2010, which is a §371 of International Application No. PCT/JP2006/315654, filed Aug. 8, 2006, and claims priority of Japanese Application No. 2005-231783, filed Aug. 10, 2005, the contents of all of which are incorporated herein by reference.

TECHNICAL FIELD

The present invention relates to a method for making upper and lower molds and an apparatus therefor.

BACKGROUND OF THE INVENTION

Some methods for making upper and lower molds are publicly known. One of them comprises the steps of holding a match-plate between cope and drag flasks, inserting upper and lower squeezing means into the respective openings of the cope and drag flasks, which openings are opposite to the match-plate, thereby defining upper and lower molding spaces, then supplying molding sand to the upper and lower molding spaces, and causing the upper and lower squeezing means to move forward to the match-plate for squeezing the molding sand in the upper and lower molding spaces so as to make flaskless upper and lower molds (see International Publication No. WO 2005/058528 A1).

DISCLOSURE OF THE INVENTION

However, the conventional method for making upper and lower molds that comprises the above steps may cause differences between the pressures that are applied to the upper and lower squeezing means when the squeezing means are caused to move forward to the match-plate, because of the differences of the forward speeds or pressures of upper and lower squeezing means, because of the difference of patterns of both sides of a match-plate, because of the difference of the thicknesses of the upper and lower molds, because of the difference of the densities of molding sand being filled in upper and lower molding spaces, etc. Therefore, the upper and lower squeezing pressures given by the driving means, which pressures cause the upper and lower squeezing means to move forward, may become different, and if so, one of the pressures will become very strong. Accordingly, the method has problems such that the resulting mold may be warped, or, at worst, the match-plate may be broken.

This invention was created to resolve these drawbacks. Its purpose is to provide a method for making upper and lower molds and an apparatus therefor that can prevent the resulting mold from being warped and the match-plate from being, broken.

To this end, the method for making the upper and lower molds comprises the steps of holding a match-plate between cope and drag flasks, inserting upper and lower squeezing means into the respective openings of the cope and drag flasks, which openings are opposite to the match-plate, thereby defining upper and lower molding spaces, then supplying molding sand to the upper and lower molding spaces, and causing the upper and lower squeezing means to move forward to the match-plate for squeezing the molding sand in the upper and lower molding spaces, wherein during the step of causing the upper and lower squeezing means to move forward to the match-plate the difference between the squeezing pressures of the upper and lower molding spaces is kept within a predetermined tolerance.

Also, the apparatus for making the upper and lower molds is one for holding a match-plate between cope and drag flasks, inserting upper and lower squeezing means into the respective openings of the cope and drag flasks, which openings are opposite to the match-plate, thereby defining upper and lower molding spaces, then supplying molding sand to the upper and lower molding spaces, and causing the upper and lower squeezing means to move forward to the match-plate for squeezing the molding sand in the upper and lower molding spaces. The apparatus comprises upper and lower driving means that cause the respective upper and lower squeezing means to move forward to, and backward from, the match-plate, upper and lower squeezing pressure-measuring means that are installed on the upper and lower driving means and that measure the respective pressures when the sand is squeezed, and a command-transmitting means that determines the difference between the values measured by the upper and lower squeezing pressure-measuring means and compares it to a predetermined tolerance. If the difference is larger than the tolerance, the command-transmitting means will send a command to the driving means so as to stop causing the driving means that has the larger pressure to move forward, until the difference falls within the predetermined tolerance.

The inventions that comprise the above components cause the upper and lower squeezing means to move forward to a match-plate by upper and lower driving means, to thereby squeeze the molding sand in the upper and lower molding spaces. During this period, the difference between the upper and lower squeezing pressures is determined based on the result of a measurement by their upper and lower measuring means and is compared with a predetermined tolerance. If the difference is larger than the predetermined tolerance, a command-transmitting means will send a command to the driving means so as to stop causing the driving means that has the larger pressure to move forward until the difference falls within the predetermined tolerance.

In this invention, each of the upper and lower driving means is a hydraulic cylinder with a hydraulic power unit or an electric cylinder with a power supply unit. If the driving means are hydraulic cylinders, then each of the upper and lower squeezing pressure-measuring means is a pressure sensor installed on the hydraulic power unit that measures the oil pressure, or a load cell that measures the force of the hydraulic cylinder. If they are electric cylinders with a power supply unit, then each of the measuring means is a voltmeter installed on the power supply unit that measures its voltage, or a load cell that measures the force of the electric cylinder. An ammeter may be used instead of the voltmeter.

The apparatus for making upper and lower molds is one that makes tight-flask upper and lower molds, or one that make flaskless upper and lower molds.

As is clear from the above explanation, the method comprises the steps of holding a match-plate between cope and drag flasks, inserting upper and lower squeezing means into the respective openings of the cope and drag flasks, which openings are opposite to the match-plate, thereby defining upper and lower molding spaces, then supplying molding sand to the upper and lower molding spaces, and causing the upper and lower squeezing means to move forward to the match-plate for squeezing the molding sand in the upper and lower molding spaces, wherein during the step of causing the upper and lower squeezing means to move forward to the match-plate the difference between the squeezing pressures of the upper and lower molding spaces is kept within a predetermined tolerance. Therefore, since the upper and lower squeezing means can be moved forward to the match-plate under the conditions that the upper and lower squeezing pressures are balanced, i.e., their difference being kept within a predetermined tolerance, the resulting mold can be prevented from being warped, or the match-plate can be prevented from being broken.

BRIEF DESCRIPTIONS OF THE DRAWINGS

FIG. 1 is a schematic diagram of an apparatus for making the upper and lower molds of the present invention.

DESCRIPTION OF A PREFERRED EMBODIMENT

Now, we discuss one embodiment of an apparatus for making upper and lower molds, referring to FIG. 1. As shown in FIG. 1, the apparatus comprises a match-plate 1, cope and drag flasks 2 and 3, upper and lower squeezing means or members 4 and 5, hydraulic cylinders 7 and 8 with a hydraulic power unit 6, upper and lower pressure sensors 9 and 10, and a command-transmitting device 11. The hydraulic cylinders 7 and 8 have functions as upper and lower driving means that cause the respective upper and lower squeezing means 4 and 5 to move forward to, and backward from, the match-plate 1. The upper and lower pressure sensors 9 and 10 are installed on the hydraulic power unit 6 and have functions as upper and lower squeezing pressure-measuring means that measure the respective pressures when the sand is squeezed. The device 11 determines the difference between the values measured by the upper and lower pressure sensors 9 and 10 and compares it to a predetermined tolerance. If the difference is larger than a predetermined tolerance, the device 11 will send a command to the hydraulic power unit 6 so as to stop causing whichever of the hydraulic cylinder 7 or 8 that has the larger pressure to move forward until the difference falls within the predetermined tolerance.

Also, the hydraulic power unit 6 has two change-over valves 13 and 14. Each valve switches an oil supply to the respective port of the hydraulic cylinders 7 and 8, which or is supplied from an oil pump 12.

The apparatus that comprises the above components holds the match-plate 1 between the cope and drag flasks 2 and 3. Then, the apparatus inserts the upper and lower squeezing means 4 and 5 into the respective openings of the cope and drag flasks 2 and 3, which openings are opposite to the match-plate 1, so as to define upper and lower molding spaces. Next, it supplies molding sand to the upper and lower molding spaces. Then, it causes the upper and lower squeezing means 4 and 5 to move forward to the match-plate 1 so as to squeeze the molding sand and make upper and lower molds.

While the molding sand in the upper and lower molding spaces is being squeezed, the upper and lower pressure sensors 9 and 10 measure the pressures of the hydraulic cylinders 7 and 8, and send the measured values to the device 11. Then the device 11 determines the difference between the pressures of the hydraulic cylinders 7 and 8. If the difference is larger than the predetermined tolerance, the device 11 will send a command to the change-over valve 13 or 14 of the hydraulic power unit 6 and change the valve position so as to stop causing whichever of the cylinder 7 or 8 that has the larger pressure to move forward until the difference falls within the tolerance. After that, while the molding sand in the upper or lower molding space is being squeezed, the pressure of the oil in the hydraulic cylinder 7 or 8 that has the smaller pressure is increased. When the difference of their pressures in the cylinders 7 and 8 becomes within the predetermined tolerance, the position of the change-over valve 13 or 14 will be changed, and whichever of the cylinder 7 or 8 that has the larger pressure will be restarted, to be moved forward. By repeating these operations and maintaining the difference between the upper and lower squeezing pressures within the predetermined tolerance, the molding sand in the upper and lower molding spaces is squeezed, and thus the squeezing will be completed.

What is claimed is:

1. A method for making upper and lower molds comprising the steps of:

holding a match-plate between cope and drag flasks;

inserting upper and lower squeezing members into respective openings of the cope and drag flasks, which openings are opposite to the match-plate, thereby defining upper and lower molding spaces;

supplying molding sand to the upper and lower molding spaces;

moving the upper and lower squeezing members forward to the match-plate to squeeze the molding sand in the upper and lower molding spaces to form the upper and lower molds, and backward from the match-plate after the squeezing of the molding sand has been completed;

measuring respective squeezing pressure values of the upper and lower squeezing members as the squeezing members are moved forward and the molding sand is squeezed;

determining a difference between the values measured; and comparing the difference to a predetermined tolerance of difference;

wherein if the difference is larger than the predetermined tolerance, the squeezing member having the larger pressure is stopped from moving forward until the difference falls within the predetermined tolerance, and after the difference falls within the predetermined tolerance the squeezing member that had the larger pressure is moved forward again.

2. The method for making upper and lower molds of claim 1, wherein the difference between the squeezing pressure values of the upper and lower squeezing members is maintained within the predetermined tolerance until the squeezing of the molding sand is complete.

* * * * *